US010808693B2

(12) United States Patent
Tojo

(10) Patent No.: US 10,808,693 B2
(45) Date of Patent: Oct. 20, 2020

(54) RECIPROCATING PUMP

(71) Applicant: MARUYAMA MFG. CO., INC., Chiyoda-ku, Tokyo (JP)

(72) Inventor: Nobuo Tojo, Tokyo (JP)

( * ) Notice: Subject to any disclaimer, the term of this patent is extended or adjusted under 35 U.S.C. 154(b) by 270 days.

(21) Appl. No.: 15/836,916

(22) Filed: Dec. 11, 2017

(65) Prior Publication Data

US 2018/0163719 A1 Jun. 14, 2018

(30) Foreign Application Priority Data

Dec. 14, 2016 (JP) ..... 2016-242173

(51) Int. Cl.

| | |
|---|---|
| ***F04B 53/16*** | (2006.01) |
| ***F04B 53/02*** | (2006.01) |
| ***F04B 9/04*** | (2006.01) |
| ***F04B 11/00*** | (2006.01) |
| ***F04B 19/22*** | (2006.01) |
| ***F04B 53/14*** | (2006.01) |
| ***F04B 53/00*** | (2006.01) |
| ***F04B 1/053*** | (2020.01) |
| ***F04B 1/0448*** | (2020.01) |
| ***F04B 1/0421*** | (2020.01) |
| ***F04B 7/02*** | (2006.01) |

(52) U.S. Cl.

CPC ..... *F04B 53/16* (2013.01); *F04B 9/045* (2013.01); *F04B 11/0091* (2013.01); *F04B 19/22* (2013.01); *F04B 53/008* (2013.01); *F04B 53/02* (2013.01); *F04B 53/143* (2013.01); *F04B 53/146* (2013.01); *F04B 1/0421* (2013.01); *F04B 1/0448* (2013.01); *F04B 1/053* (2013.01); *F04B 7/0266* (2013.01)

(58) Field of Classification Search

CPC ..... F04B 19/22; F04B 53/008; F04B 53/16; F04B 53/146; F04B 53/143; F04B 9/02; F04B 9/04–047; F04B 11/0091; F04B 53/02

USPC ..... 417/364, 415, 458, 567–571

See application file for complete search history.

(56) References Cited

U.S. PATENT DOCUMENTS

| | | | | |
|---|---|---|---|---|
| 5,385,452 | A | 1/1995 | Lyday | |
| 2011/0027106 | A1* | 2/2011 | Ochiai | F04B 1/16 417/269 |
| 2018/0058444 | A1* | 3/2018 | Blume | F04B 53/1087 |

FOREIGN PATENT DOCUMENTS

| | | |
|---|---|---|
| JP | 2005-083564 | 3/2005 |
| JP | 2010-053861 | 3/2010 |

* cited by examiner

*Primary Examiner* — Alexander B Comley
(74) *Attorney, Agent, or Firm* — Soei Patent & Law Firm

(57) ABSTRACT

A reciprocating pump includes a first manifold which includes a pump chamber, a second manifold which is connected to the first manifold, and a seal which is disposed inside the second manifold and comes into slidable contact with a plunger. A communication pipe which extends across an inside of the first manifold and an inside of the second manifold comes into contact with the seal. Additionally, the reciprocating pump includes a collar which is disposed inside the first manifold and comes into contact with the communication pipe through which the plunger is inserted. The collar, the communication pipe, and the seal are sandwiched between the inside of the first manifold and the inside of the second manifold.

19 Claims, 2 Drawing Sheets

RECIPROCATING PUMP

CROSS-REFERENCE TO RELATED APPLICATIONS

This application claims the benefit of priority from Japanese Patent Application No. 2016-242173, filed on Dec. 14, 2016, the entire contents of which are incorporated herein by reference.

FIELD

This application generally relates to a reciprocating pump.

BACKGROUND

As a related art, there is known a reciprocating pump of which a reciprocating member moves inside a cylinder portion in accordance with the driving of a drive unit to perform a pumping action of, for example, a working liquid such as water in a pump chamber formed at a front end of the cylinder portion (for example, see Japanese Unexamined Patent Publication No. 2010-53861). The reciprocating pump disclosed in Japanese Unexamined Patent Publication No. 2010-53861 includes a first manifold which includes the pump chamber, a second manifold which includes the cylinder portion in fluid communication with the pump chamber, and a crank casing which accommodates the drive unit. A high-pressure seal which comes into slidable contact with the reciprocating member to provide a water-tight seal is disposed inside the second manifold. A communication pipe through which the reciprocating member is inserted is disposed across the inside of the first manifold and the inside of the second manifold. Then, when the first manifold and the second manifold are connected to the crank casing, the communication pipe and the high-pressure seal are sandwiched and fixed between a step formed inside the first manifold and a step formed inside the second manifold. In such a reciprocating pump, the reciprocating member moves in a reciprocating manner by the driving of the drive unit. Then, when the reciprocating member retreats toward the drive unit, the pump chamber is depressurized so that the working liquid is sucked into the pump chamber in a water charging step. Meanwhile, in such a reciprocating pump, when the reciprocating member moves forward in the opposite direction in a discharge step, the pump chamber is pressurized so that the working liquid is discharged toward a discharge port (Japanese Unexamined Patent Publication No. 2010-53861).

SUMMARY

In a reciprocating pump, a reciprocating member is inserted through an inner peripheral surface of a front portion at a communication pipe assembly of the pump chamber. The inner peripheral surface of the front portion is set to be relatively large in relation to the communication pipe in the pump chamber of the first manifold so that a plunger constituting a front end of the reciprocating member does not contact the front portion due to the vibration of the plunger during operation. Accordingly, the reciprocating pump is formed to have a relatively large gap with respect to the outer peripheral surface of the plunger. However, when such a relatively large gap is provided, cavitation within the pump chamber may be generated during the water charging step and thus there is concern that the plunger, the pump chamber, or the inner peripheral surface of the communication pipe may become worn out, deteriorated, damaged, misaligned or otherwise require maintenance. Particularly, the effects of cavitation may become severe during a high-speed operation.

An object of some example embodiments in the disclosure is therefore to describe a reciprocating pump capable of eliminating or reducing the effects of cavitation, such as excessive wear, on the plunger, the pump chamber, or the inner peripheral surface of the communication pipe. Additionally, an object of some example embodiments is to improve the durability of the reciprocating pump by preventing the occurrence of the cavitation itself, and thereby improve pump efficiency.

Disclosed herein is an example reciprocating pump of which a plunger moves in a reciprocating manner inside a cylinder portion to perform a pumping action in a pump chamber formed at a front end of the cylinder portion. The reciprocating pump may comprise: a first manifold which includes the pump chamber; a second manifold connected to the first manifold and which includes the cylinder portion in fluid communication with the pump chamber; seal means which is disposed inside the second manifold and comes into slidable contact with the plunger to form a water-tight seal; and a communication pipe which is disposed across an inside of the first manifold and an inside of the second manifold. The communication pipe comes into contact with the seal means through which the plunger is inserted. Additionally, the reciprocating pump may comprise a collar which is disposed inside the first manifold and which comes into contact with the communication pipe through which the plunger is also inserted. The collar, the communication pipe, and the seal means may be sandwiched between the inside of the first manifold and the inside of the second manifold, for example as a result of the first manifold and the second manifold being connected to each other.

According to such a reciprocating pump, since the collar is disposed nearer to the pump chamber in relation to the communication pipe in the first manifold, a gap formed between the inner peripheral surface of the collar and the outer peripheral surface of the plunger can be set to be smaller than a corresponding gap of the related art. For this reason, since it is possible to reduce a volume of the gap where a working liquid enters during the charging step, it is possible to suppress the amount of air coming out from the working liquid and to prevent the occurrence of cavitation. As a result, it is possible to prevent the excessive wear and deterioration of the plunger, the pump chamber, or the inner peripheral surface of the communication pipe and to improve the durability of the reciprocating pump. Further, since it is possible to prevent the occurrence of the cavitation in this way, the pump efficiency may be improved. Also, since the gap formed at the outer peripheral side of the plunger is small, a compression ratio increases and thus the water charging performance can be improved.

An example reciprocating pump is disclosed herein in which the collar may include a first outer diameter portion which is located near the pump chamber and has a small outer diameter and a second outer diameter portion which is located next to the first outer diameter portion and forms a step. The second outer diameter portion has an outer diameter that is larger than that of the first outer diameter portion. The step of the collar may come into contact with a complimentary step formed inside the first manifold. In this case, since the smaller first outer diameter portion extends toward the pump chamber, it is possible to further reduce a volume of the gap where the working liquid enters and thus to further prevent the occurrence of the cavitation. Also, the assembly of the reciprocating pump may be facilitated by bringing the step of the collar into contact with the step of the first manifold.

An example reciprocating pump is disclosed herein in which an end surface of the collar may protrude further into the pump chamber in the axial direction of the reciprocating pump as compared to an outer peripheral edge of a front end of the plunger. In some examples, the end surface of the collar may protrude into the pump chamber further than the front end of the plunger in both of a forward limiting stroke (i.e., during the discharge step) and a backward limiting stroke (i.e., during the charging step). In this case, since the small gap formed at the outer peripheral side of the plunger starts from the outer peripheral edge of the front end of the plunger and extends continuously along at least a portion of the length of the plunger, it is possible to further reduce the volume of the gap in a cylinder portion of the reciprocating pump where the working liquid enters and thus to further prevent the occurrence of the cavitation.

Additionally, an example reciprocating pump is disclosed herein including a pump chamber, a cylinder portion fluidly coupled to the pump chamber, a plunger configured to reciprocate inside the cylinder portion, wherein the plunger comprises a front end having a peripheral edge, a seal located proximate to the cylinder portion, a communication pipe which operably connects the pump chamber to the cylinder portion, and a collar located proximate to the pump chamber. The communication pipe is located between the collar and the seal, and the peripheral edge of the plunger reciprocates through the collar during operation of the reciprocating pump. In some examples, the material of the collar may be resin. Thus, even when the plunger is being vibrated and/or otherwise displaced to contact the collar during operation, the plunger is not damaged. Also, it is possible to decrease the amount of displacement of the plunger due to the vibration by the contact of the plunger with the collar, e.g., according to the width of the gap.

In this way, according to the disclosure, since it is possible to prevent the occurrence of the cavitation, it is possible to eliminate the excessive wear and deterioration of the plunger, the pump chamber, or the inner peripheral surface of the communication pipe and to improve the durability thereof. At the same time, since it is possible to prevent the occurrence of the cavitation, the pump efficiency and t the compression ratio may both be improved. As a result, it is also possible to improve the water charging performance of the reciprocating pump.

DETAILED DESCRIPTION

Figure 1:
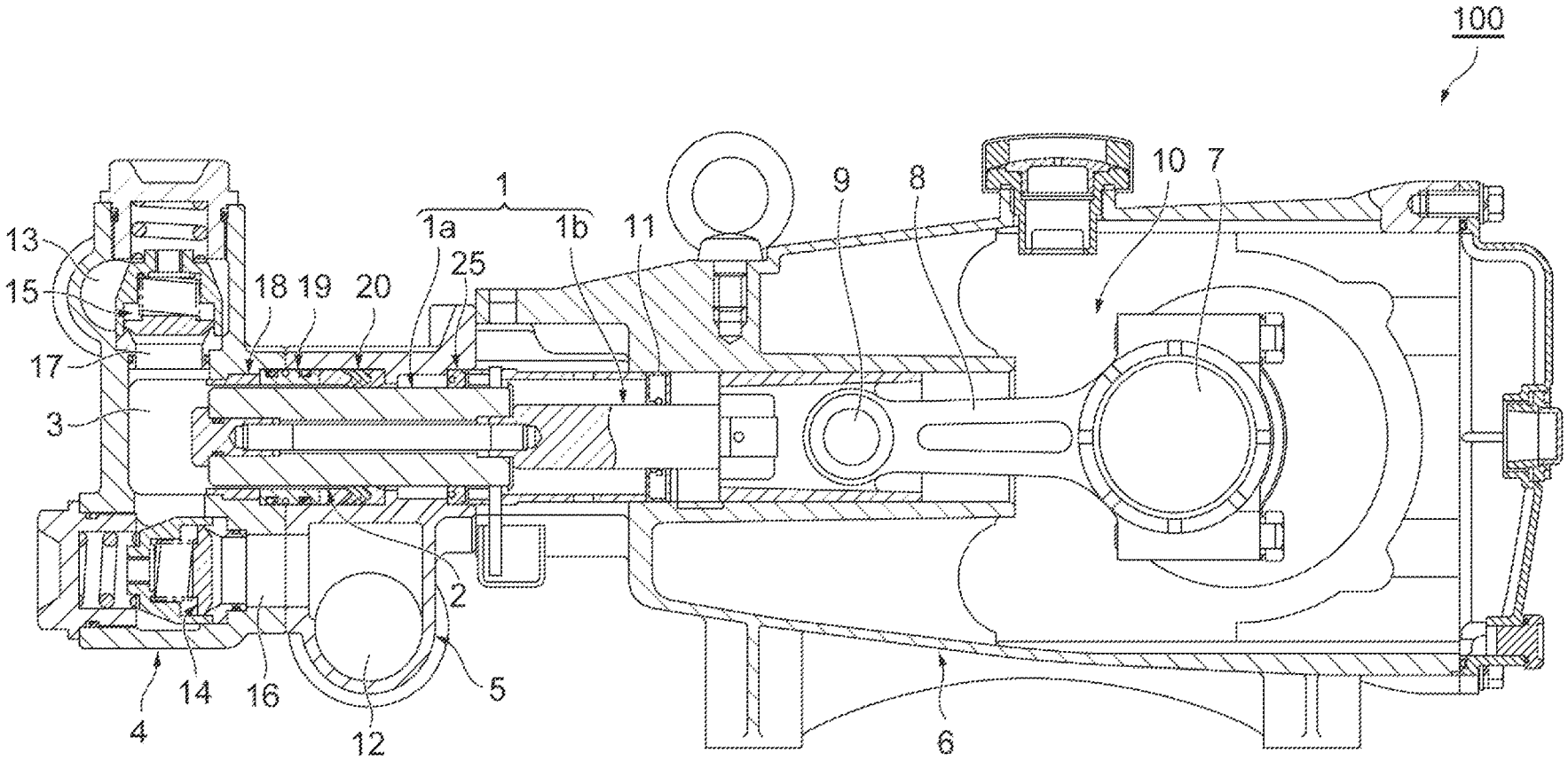
FIG. 1 illustrates a cross-sectional view of an example reciprocating pump.
Figure 2:
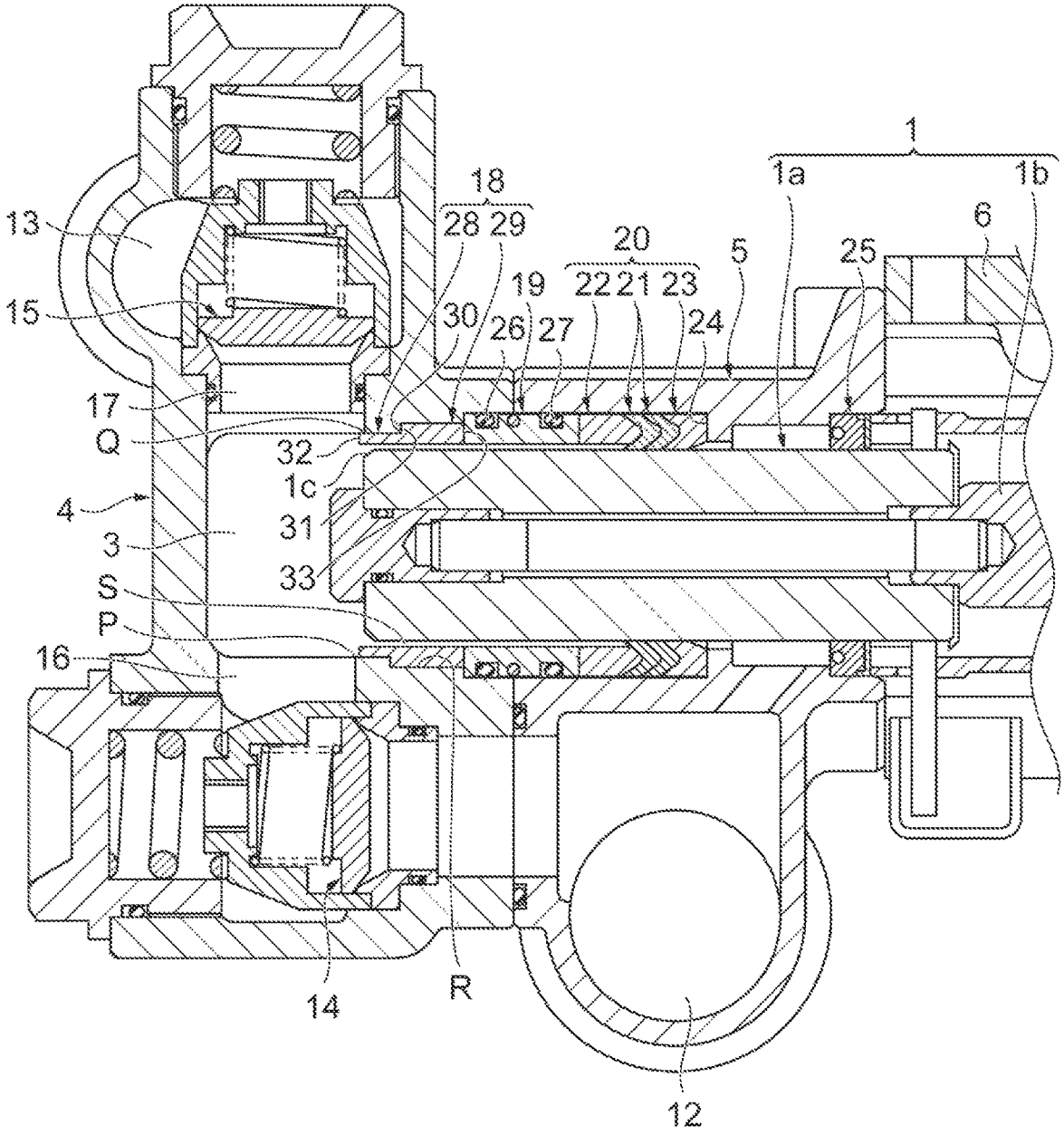
FIG. 2 illustrates an enlarged view of a front end of the example reciprocating pump of FIG. 1.

Hereinafter, a preferred embodiment of a reciprocating pump according to the disclosure will be described with reference to the accompanying drawings. FIG. 1 is a cross-sectional view of an example reciprocating pump 100 and FIG. 2 is an enlarged view of a front end of the example reciprocating pump of FIG. 1.

As shown in FIG. 1, the reciprocating pump 100 may comprise a plunger-type pump in which a reciprocating member 1 having a plunger 1*a* formed at a front half of the reciprocating member and a plunger rod 1*b* formed at a rear half of the reciprocating member moves inside the cylinder portion 2 in a reciprocating manner to perform a pumping action in cooperation with a pump chamber 3 located at a front end of the cylinder portion 2. The plunger pump 100 may comprise a first manifold 4 which includes the pump chamber 3, a second manifold 5 which includes the cylinder portion 2 in fluid communication with the pump chamber 3, and a crank casing 6. The second manifold 5 may be connected and/or fluidly coupled to both the first manifold 4 and the crank casing 6. In some examples, the first manifold 4 may comprise a discharge manifold and the second manifold 5 may comprise a water absorption manifold.

The crank casing 6 may be formed in a hollow shape. A crank shaft 7, a connecting rod 8 rotatably connected to the crank shaft 7, and a piston pin 9 rotatably connecting the plunger rod 1*b* to the connecting rod 8 are disposed in the crank casing 6. A drive unit 10 comprising the crank casing 6, the crank shaft 7, the connect rod 8, and the piston pin 9 may be configured to drive the reciprocating member 1 in a reciprocating manner. The crank casing 6 is filled with oil for lubricating and cooling the drive unit 10. An oil seal 11 which provides a water-tight seal comes into slidable contact with the outer peripheral surface of the plunger rod 1*b* at the rear half of the reciprocating member 1 is disposed on the side of the second manifold 5 in the crank casing 6 in order to prevent the leakage of the oil inside the crank casing 6. Then, when the crank shaft 7 rotates, the reciprocating member 1 moves in a reciprocating manner in the axial direction of the reciprocating pump (the horizontal direction of the drawing) through actuation of the connecting rod 8 and the piston pin 9.

The second manifold 5 which comes into contact with the crank casing 6 is provided with an intake port 12 which introduces, for example, a working liquid such as water into the pump chamber 3. The first manifold 4 which comes into contact with the second manifold 5 is provided with a discharge port 13 which discharges the working liquid compressed in the pump chamber 3. An intake valve 14 is provided in a passage 16 that fluidly couples the intake port 12 with the pump chamber 3. A discharge valve 15 is provided in a passage 17 that fluidly couples the pump chamber 3 with the discharge port 13.

The first manifold 4 and the second manifold 5 are connected and/or fluidly coupled to each other through a collar 18, a communication pipe 19, and a high-pressure seal (seal means) 20. The collar 18, the communication pipe 19, and the high-pressure seal 20 are sequentially provided in the cylinder portion 2 (e.g., in parallel) from the pump chamber 3 toward the crank casing 6.

The high-pressure seal 20 located at the front half of the reciprocating member 1 prevents the leakage of the working liquid from the pump chamber 3 toward the crank casing 6 through the cylinder portion 2. The high-pressure seal 20 is accommodated in the second manifold 5. The high-pressure seal 20 includes, as shown in FIG. 2, a V-packing 21 which is laminated in the axial direction and has an annular shape. The high-pressure seal 20 further comprises a male adapter 22 and a female adapter (a backup ring) 23 which sandwich the laminated V-packing 21 from both sides. In some examples, the high-pressure seal 20 has an annular shape. The male adapter 22 is disposed near the pump chamber 3 and the female adapter 23 is provided near the crank casing 6.

The V-packing 21 may be formed of, for example, an elastic body such as rubber and comes into slidable contact with the plunger 1*a* to form a water-tight seal. The male adapter 22 may be formed of, for example, resin or the like.

The male adapter 22 has a gap formed between the inner peripheral surface of the male adapter 22 and the outer peripheral surface of the plunger 1*a* so that the plunger 1*a* is inserted therethrough. The female adapter 23 may be formed of, for example, resin or the like. The female adapter 23 has a slight gap formed between the inner peripheral surface of the female adapter 23 and the outer peripheral surface of the plunger 1*a*. The female adapter 23 comes into contact with a step 24 formed inside the second manifold 5.

In addition, for example, a low-pressure seal 25 may be disposed at a position separated from the high-pressure seal 20 toward the crank casing 6 in the second manifold 5 to come into slidable contact with the outer peripheral surface of the plunger 1*a* and to form a water-tight seal. In some examples, the low-pressure seal 25 may comprise U-packing which prevents the leakage of the working liquid toward the crank casing 6 in the event of any leakage of the working fluid from the high-pressure seal 20.

The communication pipe 19 may be formed of, for example, metal or the like and is formed in a cylindrical shape so that the outer diameter is substantially the same as the outer diameter of the high-pressure seal 20. The communication pipe 19 extends across the inside of the first manifold 4 and the inside of the second manifold 5 and comes into contact with the male adapter 22. An annular gap is formed between the inner peripheral surface of the communication pipe 19 and the outer peripheral surface of the plunger 1*a* when the plunger 1*a* is inserted through the communication pipe 19. A first O-ring 26 is disposed between the first manifold 4 and the outer peripheral surface of the communication pipe 19 and a second O-ring 27 is disposed between the second manifold 5 and the outer peripheral surface of the communication pipe 19. These O-rings 26 and 27 are configured to prevent the leakage of the working liquid along the outer peripheral surface of the communication pipe 19.

The collar 18 may be formed of, for example, resin or the like and is formed in a stepped cylindrical shape. The collar 18 includes a first outer diameter portion 28 which is located near the pump chamber 3 and a second outer diameter portion 29 which is located next to the first outer diameter portion 28 and forms a step 30. In some examples, the second outer diameter portion 29 has an outer diameter that is larger than the outer diameter of the first outer diameter portion 28. Additionally, the second outer diameter portion 29 may comprise an inner diameter equal to the inner diameter of the smaller first outer diameter portion 28. The collar 18 is accommodated in the first manifold 4. The outer diameter of the larger second outer diameter portion 29 is smaller than the outer diameter of the communication pipe 19 and is larger than the inner diameter of the communication pipe 19. The step 30 of the collar 18 comes into contact with an adjacent step 31 formed in the first manifold 4 and the larger second outer diameter portion 29 comes into contact with the communication pipe 19. In some examples, the smaller first outer diameter portion 28 of the collar 18 extends toward the pump chamber 3 in the first manifold 4. Further, the outer peripheral surfaces of the smaller first outer diameter portion 28 and the larger second outer diameter portion 29 of the collar 18 come into close contact with the inner surface of the first manifold 4. The collar 18 has a clearance or gap S formed between the inner peripheral surface thereof and the outer peripheral surface of the plunger 1*a* so that the plunger 1*a* is inserted therethrough.

When the plunger 1*a* is located at the forward limiting stroke (e.g., at the top dead center rotation of the crank shaft 7), an outer peripheral edge 1*c* of the front end of the plunger 1*a* is located in the vicinity of edges P and Q of the second manifold 5 near to the passages 16 and 17. In this way, in a state where the plunger 1*a* is located at the forward limiting stroke, an end surface 32 of the smaller first outer diameter portion 28 of the collar 18 is disposed to slightly protrude in the axial direction toward the pump chamber 3. The end surface 32 of the first outer diameter portion 28 may extend as far or further into the pump chamber 3 as compared to the outer peripheral edge 1*c* of the front end of the plunger 1*a*. The first end 32 of the collar 18 projects into the pump chamber 3. An end surface 33 of the second outer diameter portion 29, or the second end 33 of the collar 18, contacts the communication pipe 19. In some examples, at both the forward limiting stroke and the backward limiting stroke of the plunger during operation of the reciprocating pump 100, the outer peripheral edge 1*c* of the plunger 1*a* continuously remains located between the first end 32 and the second end 33 of the collar 18.

The first manifold 4 may be fixed to the crank casing 6 through the second manifold 5 by, for example, bolts which are a plurality of fastening means so that the first and second manifolds 4 and 5 are integrally connected to the crank casing 6. Accordingly, the collar 18, the communication pipe 19, and the high-pressure seal 20 are sandwiched between the first step 31 located inside the first manifold 4 and the second step 24 located inside the second manifold.

In some examples, a difference in inner diameter between the collar 18 and the male adapter 22 may be 1 mm or less. Further, i a difference between the outer diameter of the plunger 1*a* and the inner diameter of each of the collar 18, the communication pipe 19, and the male adapter 22 may be 2 mm or less. In some examples, the differences in diameter are made relatively small in order to minimize leakage and/or to help ensure a proper alignment between the plunger 1*a* and the surrounding components during operation of the plunger pump 100.

Then, in such a plunger pump 100, the crank shaft 7 rotates so that the reciprocating member 1 connected to the crank shaft 7 through the connecting rod 8 and the piston pin 9 moves in a reciprocating manner. Since the reciprocating member 1 retreats toward the drive unit 10 in the water charging step, the pump chamber 3 is depressurized. Then, the intake valve 14 and the discharge valve 15 of the manifolds 4 and 5 are respectively opened and closed and the working liquid is sucked into the pump chamber 3 through the intake port 12 and the intake valve 14. Following the water charging step, the reciprocating member 1 advances in the opposite direction in the discharge step, and the pump chamber 3 is pressurized. Then, the intake valve 14 and the discharge valve 15 are respectively closed and opened so that the working liquid of the pump chamber 3 is discharged to the discharge port 13 through the discharge valve 15. In this way, a pumping action is performed in the plunger pump 100.

In the related art, the collar 18 is not provided. For illustrative purposes only, and not to suggest that the prior art necessarily includes the additional features or combinations of features illustrated in the present drawings, the prior art may be distinguished with respect to the plunger pump 100 by way of reference to FIG. 2. In the prior art, a comparatively large gap is formed between the outer peripheral surface of the plunger 1*a* and the inner peripheral surface R (see FIG. 2) of the first manifold 4. Since the comparatively large gap is connected to the pump chamber 3 with a uniform width from the communication pipe 19, a negative pressure is formed inside the pump chamber 3 when the plunger 1*a* retreats toward the backward limiting stroke (e.g., at the bottom dead center rotation of the crank shaft 7) in the water charging step and thus air is separated from the working liquid. For this reason, there is concern that a cavitation may be formed due to a large gap in the prior art pump systems.

However, in the example embodiment illustrated by FIG. 2, the collar 18 through which the plunger 1*a* is inserted extends as far or further into the pump chamber 3 as compared to to the communication pipe 19 of the first manifold 4. Accordingly, the gap S formed between the inner peripheral surface of the collar 18 and the outer peripheral surface of the plunger 1*a* can be set to be smaller than the gap of the related art. In some examples, the width of the gap S may be approximately 2 mm or less. For this reason, since it is possible to reduce a volume of the gap S where the working liquid enters, it is possible to suppress the amount of the air coming out of the working liquid and to prevent the cavitation affecting the pump. As a result, since it is possible to eliminate the excessive wear and/or deterioration of the plunger 1*a*, the pump chamber 3, and the inner peripheral surface of the communication pipe 19, durability of the plunger pump 100 can be improved. Since the occurrence of the cavitation can be prevented or minimized in this way, the pumping efficiency can be improved. Further, since the gap S formed at the outer peripheral side of the plunger 1*a* is small, the compression ratio is increased and thus the water charging performance can be improved.

Further, in some examples, the collar 18 includes the smaller first outer diameter portion 28 which is located near the pump chamber 3 and the larger second outer diameter portion 29 which extends to the first outer diameter portion 28 through the step 30 and has an outer diameter which is larger than the outer diameter of the first outer diameter portion 28. The step 30 of the collar 18 comes into contact with the step 31 formed inside the first manifold 4 and the first outer diameter portion 28 extends toward the pump chamber 3. Accordingly, in the embodiment, since it is possible to reduce a volume of the gap S where the working liquid enters, it is possible to further suppress the occurrence of the cavitation. Further, assembly of the plunger pump 100 may be facilitated by bringing the step 30 of the collar 18 into contact with the step 31 of the first manifold 4.

Further, in a state where the plunger 1*a* is located at the forward limiting stroke, the end surface 32 of the collar 18 that protrudes in the axial direction may extend as far or further into the pump chamber 3 as compared to the outer peripheral edge 1*c* of the front end of the plunger 1*a*. For this reason, since the small gap S formed at the outer peripheral side of the plunger 1*a* starts from the outer peripheral edge 1*c* of the front end of the plunger 1*a*, it is possible to further reduce the volume of the gap S where the working liquid enters and thus to further prevent the occurrence of the cavitation.

Further, in example embodiments in which the material of the collar 18 is resin, damage to the plunger 1*a* may be prevented even when the plunger 1*a* is vibrated to contact the collar 18 during an operation of the plunger pump 100. In some examples, the resin may comprise a softer material as compared to the material used in the fabrication of the plunger 1*a*. Further, the collar 18 may be configured to decrease the amount or distance of vibration of the plunger 1*a* as a result of contact between the plunger 1*a* and the collar 18.

In example embodiments in which the collar 18 and the male adapter 22 are formed of resin and sandwich the communication pipe 19, the amount of vibration of the plunger 1*a* may be minimized according to the width of the gap S. Additionally, damage to the plunger 1*a* may be prevented even when the plunger 1*a* is vibrated to contact the male adapter 22 similarly to the collar 18.

Further, the materials of the collar 18 and the male adapter 22 are not limited to resin and may be a material which does not damage the plunger 1*a* even when contacting the plunger 1*a*.

It is to be understood that not all aspects, advantages and features described herein may necessarily be achieved by, or included in, any one particular example embodiment. Indeed, having described and illustrated various examples herein, it should be apparent that other examples may be modified in arrangement and detail.

For example, in the above-described embodiments, the high-pressure seal (seal means) 20 is formed as the seal having the V-packing 21, but other packings or seal members may be used. Further, the disclosure can be applied to the reciprocating pump of which the plunger 1*a* moves in a reciprocating manner by the driving of the drive unit 10 to perform a pumping action in the pump chamber 3.

We claim all modifications and variations coming within the spirit and scope of the subject matter claimed herein.

What is claimed is:

1. A reciprocating pump comprising:

a first manifold which includes a pump chamber fluidly coupled to at least one discharge passage;

a second manifold connected to the first manifold and which includes a cylinder portion fluidly coupled to the pump chamber;

a plunger configured to reciprocate inside the cylinder portion in an axial direction of the cylinder portion, wherein a front end of the plunger includes an outer peripheral edge that extends into the pump chamber during a forward limiting stroke of the plunger, and wherein the at least one discharge passage of the first manifold extends from the pump chamber in a radial direction with respect to the axial direction of the cylinder portion;

a seal which is disposed inside the second manifold and comes into slidable contact with the plunger;

a communication pipe which extends across an inside of the first manifold and an inside of the second manifold and comes into contact with the seal; and a collar which is disposed inside the first manifold and comes into contact with the communication pipe, wherein a front end of the collar includes a cylindrical end surface which protrudes in the axial direction of the cylinder portion and which terminates between the discharge passage and the outer peripheral edge of the plunger in the axial direction of the cylinder portion during the forward limiting stroke of the plunger, and wherein the collar, the communication pipe, and the seal are sandwiched between the first manifold and the second manifold.

2. The reciprocating pump according to claim 1, wherein the collar includes a first outer diameter portion having the cylindrical end surface which is located near the pump chamber and a second outer diameter portion which is located next to the first outer diameter portion to form a step, and wherein the second outer diameter portion has a larger outer diameter as compared to the first outer diameter portion.

3. The reciprocating pump according to claim 1, wherein the cylindrical end surface of the collar extends at least as far or further into the pump chamber as compared to the outer peripheral edge of the front end of the plunger when the plunger is located at the forward limiting stroke.

4. The reciprocating pump according to claim 3, wherein a gap having a substantially uniform width is formed between an inner surface of the communication pipe and the plunger, and wherein an inner peripheral surface of the collar is spaced apart from the plunger by an amount of clearance that is approximately equal to the uniform width of the gap.

5. The reciprocating pump according to claim 4, wherein the uniform width gap extends continuously along a partial length of the plunger from the communication pipe to the outer peripheral edge of the front end of the plunger.

6. The reciprocating pump according to claim 5, wherein the uniform width gap extends continuously along the partial length of the plunger from at least a portion of the seal to the outer peripheral edge of the front end of the plunger.

7. The reciprocating pump according to claim 4, wherein the uniform width of the gap is approximately 2 mm or less.

8. The reciprocating pump according to claim 1, wherein the collar comprises a resin material which is softer than the plunger.

9. The reciprocating pump of claim 1, wherein an inner peripheral surface of the front end of the collar forms a cylindrical shaped opening of the collar that opens into the pump chamber in the axial direction of the cylinder portion.

10. A reciprocating pump comprising:

a pump chamber;

a cylinder portion fluidly coupled to the pump chamber;

a plunger configured to reciprocate inside the cylinder portion in an axial direction of the cylinder portion, wherein the plunger comprises a front end having an outer peripheral edge that extends into the pump chamber during a forward limiting stroke of the plunger;

at least one discharge passage fluidly coupled to the pump chamber and extending in a radial direction with respect to the axial direction of the cylinder portion;

a seal located proximate to the cylinder portion;

a communication pipe which operably connects the pump chamber to the cylinder portion; and a collar located proximate to the pump chamber, wherein a front end of the collar includes a cylindrical end surface which protrudes in the axial direction of the cylinder portion and which terminates between the discharge passage and the outer peripheral edge of the plunger in the axial direction of the cylinder portion during the forward limiting stroke of the plunger, wherein the communication pipe is located between the collar and the seal, and wherein the outer peripheral edge of the plunger reciprocates within the collar during operation of the reciprocating pump.

11. The reciprocating pump of claim 10, wherein the communication pipe and the collar form a substantially uniform gap along a partial length of the plunger.

12. The reciprocating pump of claim 11, wherein the uniform gap extends along the partial length of the plunger from the communication pipe to the outer peripheral edge of the plunger during both the forward limiting stroke and a backward limiting stroke of the plunger.

13. The reciprocating pump of claim 12, wherein the uniform gap continues along the partial length of the plunger into a space formed between the seal and the plunger.

14. The reciprocating pump according to claim 11, wherein a width of the uniform gap is approximately 2 mm or less.

15. The reciprocating pump of claim 10, wherein the collar comprises a second end that contacts the communication pipe, and wherein at both the forward limiting stroke and a backward limiting stroke of the plunger during the operation of the reciprocating pump, the outer peripheral edge of the plunger remains located between the front end and the second end of the collar.

16. The reciprocating pump of claim 10, wherein the collar, the communication pipe, and the seal are sandwiched together as a result of operably connecting the pump chamber to the cylinder portion.

17. A reciprocating pump comprising:

a pump chamber;

a cylinder portion fluidly coupled to the pump chamber;

a plunger configured to reciprocate inside the cylinder portion in an axial direction of the cylinder portion, wherein a front end of the plunger comprises an outer peripheral edge that extends into the pump chamber during a forward limiting stroke of the plunger;

at least one discharge passage extending from the pump chamber in a radial direction with respect to the axial direction of the cylinder portion;

seal means located proximate to the cylinder portion;

means for connecting the pump chamber to the cylinder portion; and a collar located proximate to the pump chamber, wherein a front end of the collar includes a cylindrical end surface which protrudes in the axial direction of the cylinder portion and which terminates between the discharge passage and the outer peripheral edge of the plunger in the axial direction of the cylinder portion during the forward limiting stroke of the plunger, wherein the means for connecting is located between the collar and the seal means, and wherein the outer peripheral edge of the plunger reciprocates within the collar during operation of the reciprocating pump.

18. The reciprocating pump of claim 17, wherein the collar and the means for connecting form a uniform gap along at least a partial length of the plunger that extends from the seal means to the outer peripheral edge of the plunger.

19. The reciprocating pump of claim 18, wherein the collar comprises a second end that contacts the means for connecting, and wherein at both the forward limiting stroke and a backward limiting stroke of the plunger during the operation of the reciprocating pump, the outer peripheral edge of the plunger remains located between the front end and the second end of the collar.

* * * * *